United States Patent [19]

Laimer

[11] 4,345,747

[45] Aug. 24, 1982

[54] FILLING STAND FOR POURING MOLTEN METAL FROM A TILTABLE METALLURGICAL VESSEL INTO A METALLURGICAL LADLE

[75] Inventor: Friedrich Laimer, Perg, Austria

[73] Assignee: Voest-Alpine Aktiengesellschaft, Linz, Austria

[21] Appl. No.: 169,417

[22] Filed: Jul. 16, 1980

[30] Foreign Application Priority Data

Aug. 9, 1979 [AT] Austria ..... 5430/79

[51] Int. Cl.[3] ..... C21B 7/14

[52] U.S. Cl. ..... 266/240; 266/276; 75/13; 75/46; 75/49; 222/594

[58] Field of Search ..... 266/240, 276, 277; 75/13, 46, 49; 222/590, 591, 594

[56] References Cited

U.S. PATENT DOCUMENTS 1,712,287 5/1929 Allen ..... 266/240

3,791,638 2/1974 Evans ..... 266/240

*Primary Examiner*—L. Dewayne Rutledge

*Assistant Examiner*—David A. Hey

*Attorney, Agent, or Firm*—Brumbaugh, Graves, Donohue & Raymond

[57] ABSTRACT

In a filling stand for pouring molten metal from a tiltable metallurgical vessel into a metallurgical ladle, the metallurgical ladle is surrounded by a casing to which at least one exhaust conduit is connected. In the casing upper part a pour-in opening for the molten metal is provided, which opening is arranged below an outlet of the tiltable vessel. In order to keep the exhaust and filter performance of the exhaust system low, at least one part of the ladle surrounding casing which comprises the pour-in opening is displaceable in the tilting plane of the tiltable vessel in accordance with the change of position of the metal jet streaming out of the outlet of the tiltable vessel.

12 Claims, 7 Drawing Figures

FILLING STAND FOR POURING MOLTEN METAL FROM A TILTABLE METALLURGICAL VESSEL INTO A METALLURGICAL LADLE

BACKGROUND OF THE INVENTION

The invention relates to a filling stand for pouring molten metal from a tiltable metallurgical vessel into a metallurgical ladle, in particular for pouring molten pig iron from a pig iron mixer into a transporting ladle. In such an arrangement the metallurgical ladle is surrounded by a casing to which at least one exhaust conduit is connected and in whose upper part a pour-in opening for the molten metal is arranged below an outlet of the tiltable vessel.

A filling stand of this kind is known from German Auslegeschrift No. 2,056,261. The ladle to be filled with pig iron in this filling stand, is placed on a ladle carriage which is displaceable in a pit below the floor. On one end thereof, the top of the pit is closed by a stationary cover defining a pour-in opening. By means of the ladle carriage the ladle is movable to a position below the pour-in opening, and the side of the pit is closeable by a shield mounted on the ladle carriage. Exhaust conduits for exhausting the smoke forming during the pouring of the molten metal, run into this pit. A tight sealing of the pit by means of the shield mounted on the ladle carriage is difficult to achieve, so secondary air has to be sucked through the gaps in the seal, which air has to be exhausted from the pit together with the smoke forming therein. Since the metal jet emerging from the tiltable metallurgical vessel changes its position in dependence on the position of the spout of the tiltable vessel, a further disadvantage of this known filling stand is to be seen in the fact that the pour-in opening has to be very large in order to let the metal jet through, both while the tiltable metallurgical vessel is full and also when it is almost empty. Due to this large pour-in opening additional large amounts of secondary air are sucked in, which air has to be exhausted together with the smoke. Consequently, with this known plant, the exhaust system has to be designed substantially larger and stronger than would be necessary for capturing only the smoke amounts forming during the pouring procedure.

SUMMARY OF THE INVENTION

The invention aims at avoiding these disadvantages and difficulties and has as its object to provide a filling stand of the initially-defined kind in which only small amounts of secondary air are sucked into the exhaust system, whereby it is possible to keep the exhaust and filtering requirements of the exhaust system accordingly low. Furthermore, the filling stand is to be small and of a simple construction so that installation into already existing production plants is possible at a later point in time.

These objects are achieved according to the invention in that at least one part of the ladle-surrounding casing, that includes the pour-in opening, is displaceable in the tilting plane of the tiltable vessel by a distance related to the change of position of the metal jet streaming out of the outlet of the tiltable vessel. By displacing the casing part that includes the pour-in opening the position of the pour-in opening can be adapted to the position of the outstreaming metal jet, which depends on the height of the melt level and on the tilting angle of the tiltable metallurgical vessel. Consequently the size of the pour-in opening only needs to be large enough that problem-free filling of the ladle is possible with the metal jet penetrating the pour-in opening approximately centrally.

A preferred embodiment is characterized in that the upper part of the casing is displaceable in the horizontal direction relative to the stationarily arranged lower part of the casing, wherein the upper part of the casing advantageously is designed as a horizontal ceiling covering a base pit. The lower part of the casing is arranged in the base pit. This constitutes a particularly simple mode of construction for a filling stand.

Preferably, the displaceable upper part comprises side wall parts adjacent to the ceiling with an exhaust opening for the exhaust conduit arranged in at least one of its side wall parts.

Suitably, the side walls of the lower casing part that are arranged transversely to the displacement direction are designed to be reinforced in a flange-like manner in the displacement direction of the upper part, so that the displaceable upper part, in each of its positions, is perfectly sealed relative to the stationary lower part.

A particularly good sealing is achieved if the side wall parts that are arranged in the displacement direction of the upper part are sealed relative to the lower part of the casing by means of sealing ledges, preferably by means of L-shaped sealing ledges which engage in recesses in the respective side walls of the lower part of the casing.

Preferably, each of the side wall parts arranged in the displacement direction of the upper part is provided with a separate exhaust opening allocated to an exhaust conduit.

In order that the metallurgical ladle always assumes the same position within the casing, centering means are provided in the bottom of the casing for securing the position of the metallurgical ladle.

For the perfect sealing of the exhaust opening, the exhaust opening, on the outer side of the casing, is provided with a preferably oval flange extending in the displacement direction of the upper part. The exhaust conduit is positioned after this flange and has a transition part that is widened in the displacement direction of the upper part, the total flow-through cross section thus being guaranteed in every position of the upper part.

A further preferred embodiment is characterized in that the ceiling of the upper part of the casing that includes the pour-in opening, is connected with the lower part of the ceiling, thus being displaceable together with the lower part of the casing.

BRIEF DESCRIPTION OF THE DRAWINGS

The invention will now be explained in more detail by way of two embodiments with reference to the accompanying drawings, wherein.

DESCRIPTION OF EXEMPLARY EMBODIMENTS

Figure 1:
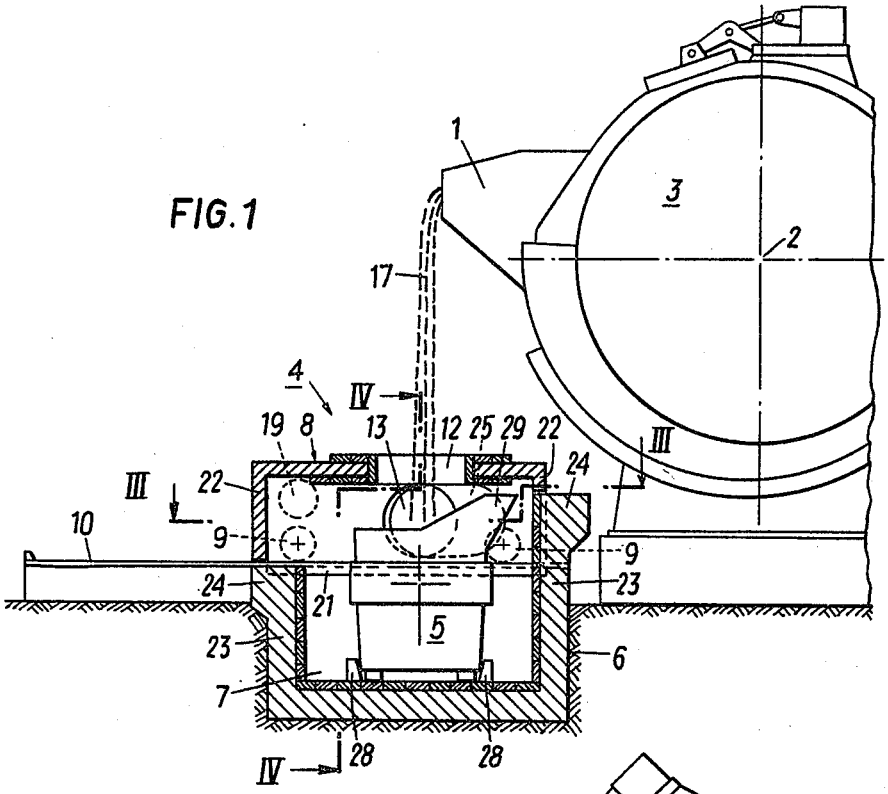
FIG. 1 is a section through a first embodiment of a filling stand, laid in the tilting plane of the tiltable metallurgical vessel, with the tiltable metallurgical vessel almost completely filled.

Below an outlet 1 of a metallurgical vessel 3 that is tiltable about an axis 2, a casing 4 is arranged, which casing serves for accommodating a transporting ladle 5. The casing 4 is comprised of a stationary lower part 7 arranged in a base pit 6 and an upper part 8 which is displaceable and movable in the tilting plane 11 of the metallurgical vessel 3 on wheels 9 running on horizontally arranged rails 10. In the movable upper part 8 a pour-in opening 12 and at least one exhaust opening 13 are provided in the ceiling. In the embodiments, filling stands with two oppositely arranged exhaust openings 13 each are illustrated. The exhaust openings 13 have circular cross sections and run into exhaust conduits 16 (FIG. 3) stationarily laid in the mill floor, via oval-conical transition parts 15 having oval openings 14.

With the metal level in the tiltable metallurgical vessel 3 decreasing, the latter has to be tilted more. Thus, the outflowing metal jet 17 shifts by a certain distance in the tilting plane of the tiltable metallurgical vessel 3. By moving of the upper part 8, the pour-in opening 12 follows the respective position of the metal jet 17, as can be seen from the different positions of the upper part 8 of the casing 4 and the metal jet 17 in FIGS. 1 and 2. Thereby it is possible to keep the pour-in opening 12 as small as is just necessary for the metal jet. The maximum shift of the metal jet 17 thereby corresponds to the distance 18.

In the embodiments illustrated, a gear motor 19 driving the wheels 9 is provided as a drive for the upper part 8. Instead of the gear motor, a pressure medium cylinder may also be provided, which on the one hand is stationary and on the other hand is hinged to the upper part 8. According to another variant, a spindle driven by an adjusting motor or a rope winch can be installed instead of the pressure medium cylinder.

Figure 4:
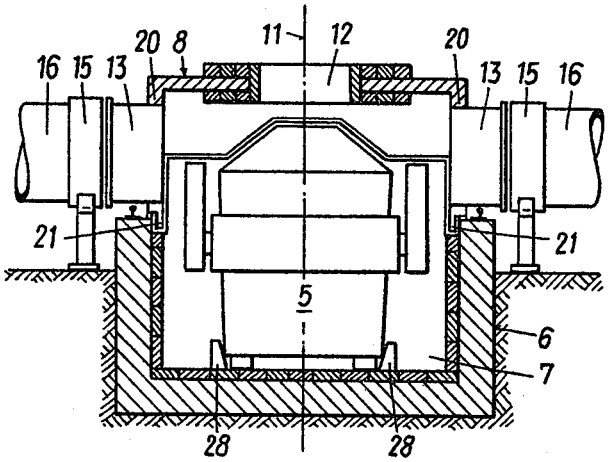
FIG. 4 is a section along line IV—IV of FIG. 1.

The sealing between the stationary lower part 7 and the displaceable upper part 8 of the casing 4 is realized by means of L-shaped sealing ledges 21 as shown in FIG. 4, which ledges are fastened to the side walls 20 of the displaceable upper part 8 that extend in the moving direction. At the front and rear side walls 22 that extend transversely to the moving direction, the sealing is effected by a flange-like expansion of the upper rims 24 of the corresponding side walls 23 of the lower part 7. The widths of the rims 24 corresponding to at least the maximum displacement distance 18 plus the wall thickness of one of the side walls 22 of the upper part 8.

Figure 3:
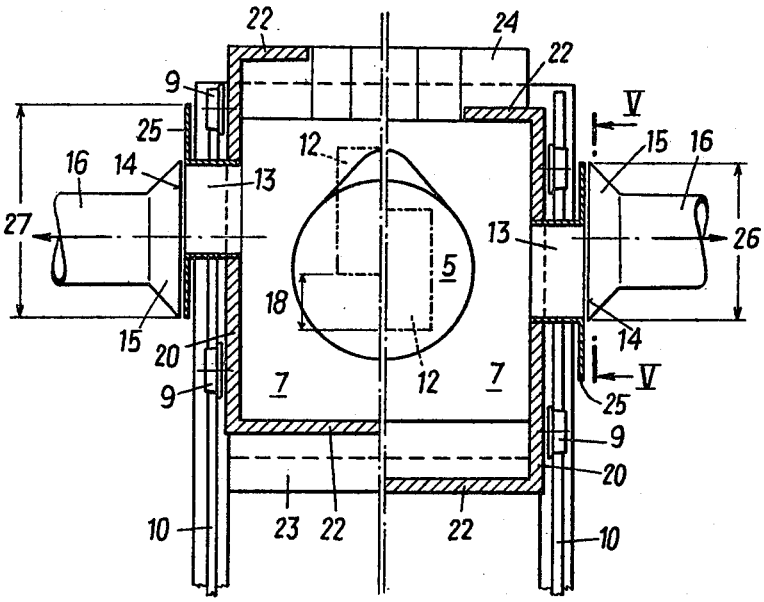
FIG. 3 is a section along line III—III of FIG. 2.
Figure 5:
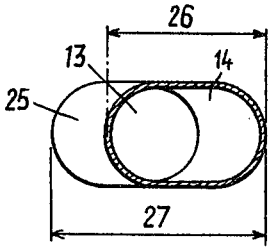
FIG. 5 represents a detail of the filling stand according to the section along line V—V of FIG. 3.

The outer sides of the exhaust openings 13 located in the side walls 20 of the movable upper part 8 are provided with oval flanges 25 whose longitudinal axes are directed in the moving direction of the movable upper part 8, as can be seen from FIGS. 3 and 5. As can be seen from FIG. 5, each flange 25 slides over the oval opening 14 of the respective oval-conical transition part 15 when the upper part is moved, in order to cover the area of the oval opening 14 that is not directly across from the circular exhaust opening 13. If the oval opening 14 has a predetermined length 26 along its longitudinal axis in the moving direction, the length 27 of the longitudinal axis of the oval flange 25 must equal at least the sum of the length 26 plus the displacement distance 18.

Figure 2:
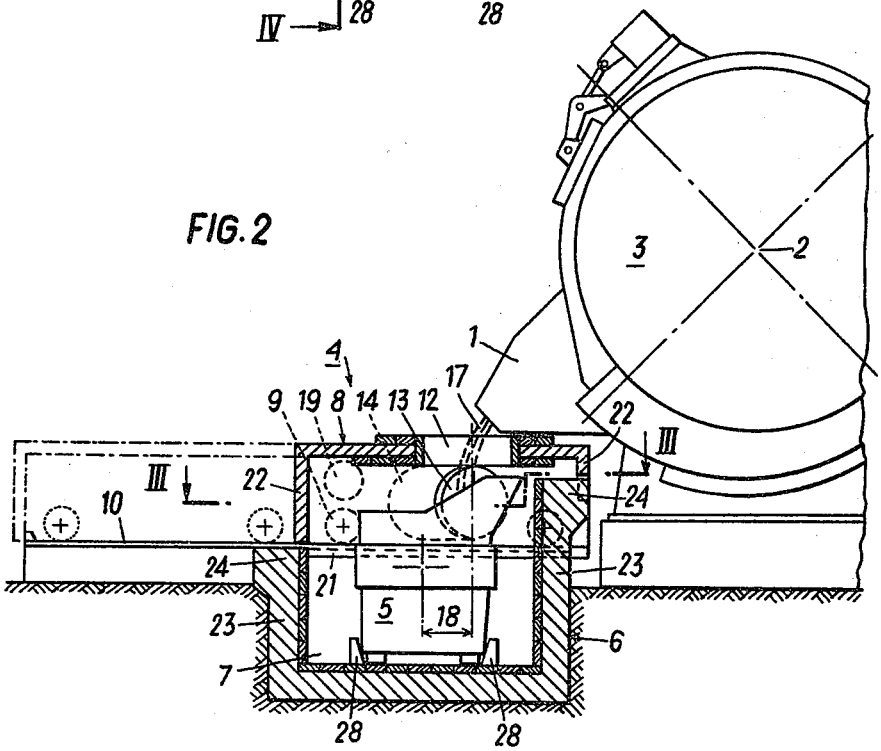
FIG. 2 is a section analogous to FIG. 1, with the tiltable metallurgical vessel almost emptied.

In order to ensure the correct positioning of the transporting ladle 5 in the casing 4, after it has been introduced therein by a lifting means such as a crane, centering means 28 are provided on the bottom of the casing 4. For introducing the transporting vessel 5, the movable upper part 8 is moved away from the metallurgical vessel 3 to such an extent that the stationary lower part 7 of the casing 4 is freely accessible. This is illustrated in FIG. 2 in dot-and-dash lines.

Depending on the requirements, the transporting ladle 5 may be provided with a pouring spout 29. If this is the case, it is necessary to adapt the stationary lower part 7 and the movable upper part 8, at the side facing the metallurgical vessel 3, to the pouring spout, as is to be seen from FIG. 4.

Figure 6:
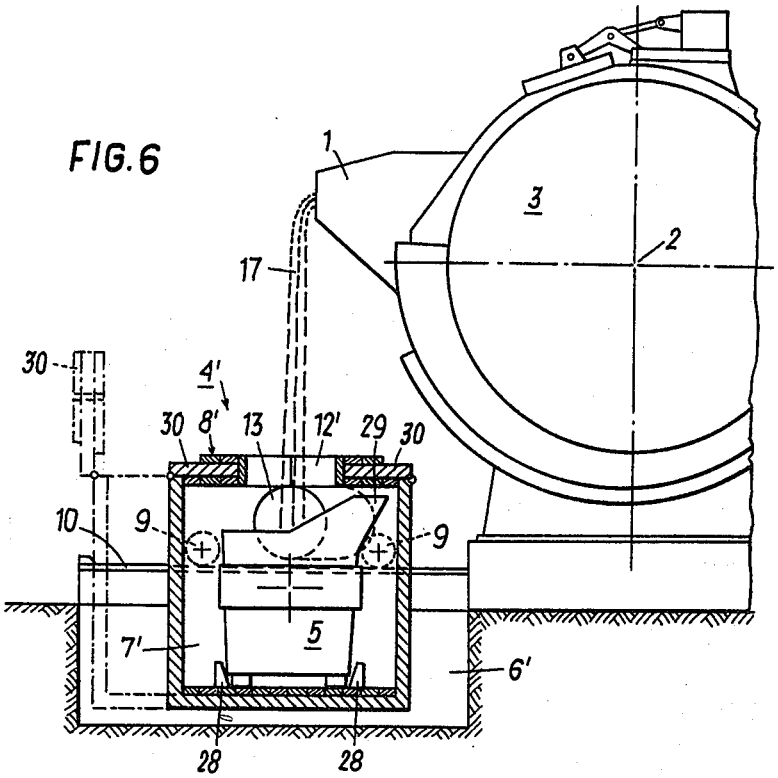
FIGS. 6 and 7 represent a further embodiment of the filling stand according to the invention, in illustrations analogous to FIGS. 1 and 2.
Figure 7:
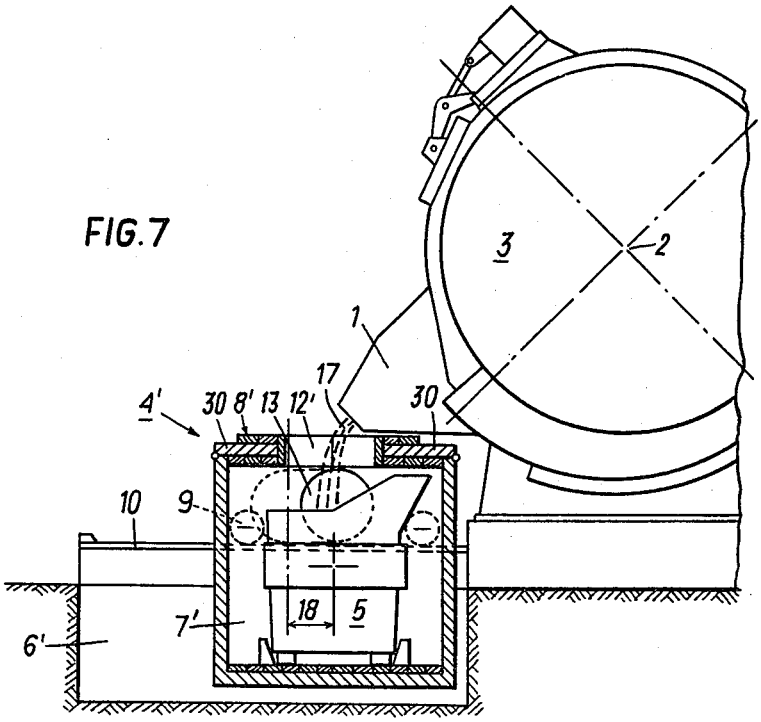

With the embodiment of the filling stand illustrated in FIGS. 6 and 7, the entire casing 4', i.e. its upper part 8' and lower part 7', is movable in a base pit 6' in the tilting plane 11 of the tiltable metallurgical vessel 3. The ceiling 30 of the casing 4' has a pour-in opening 12' and is pivotable into the position illustrated in FIG. 6 in dot-and-dash lines for the purpose of introducing and removing the transporting ladle 5. The connections to the exhaust conduits as well as the drive of the casing 4' are designed in a manner analogous to those of the embodiment illustrated in FIGS. 1 to 5.

The filling stand according to the invention is applicable anywhere where molten metal is being poured from tiltable metallurgical vessels into transporting vessels that have been deposited on a foundation, i.e. are not suspended on lifting means, as for instance when pouring pig iron from a stationarily arranged or a movable mixer, or when tapping open hearth furnaces, electric-arc furnaces LD-crucibles, induction furnaces for iron and non-iron metallurgy, and the like.

What I claim is:

1. In a filling stand arrangement to be used for pouring molten metal from a tiltable metallurgical vessel into a metallurgical ladle, for example for pouring molten pig iron from a pig iron mixer into a transporting ladle, and of the type including a tiltable metallurgical vessel including an outlet for pouring out a molten metel jet, a metallurgical ladle, a casing surrounding said metallurgical ladle and comprised of a casing lower portion and a casing upper portion, at least one exhaust conduit being connected to said casing, and a pour-in opening for receiving the molten metal jet provided in said casing upper portion below said outlet of said tiltable metallurgical vessel, the improvement which is characterized in that at least a part of the casing that includes said pour-in opening is displaceable in the tilting plane of said tiltable metallurgical vessel by a distance related to a change in the position of said molten metal jet streaming out of said outlet of said tiltable metallurgical vessel.

2. A filling stand arrangement as set forth in claim 1, wherein said casing lower portion is stationarily arranged and said casing upper portion is horizontally displaceable relative to said casing lower portion.

3. A filling stand arrangement as set forth in claim 2, further comprising a base pit for accommodating said casing lower portion and wherein said casing upper portion is designed as a horizontal ceiling covering said base pit.

4. A filling stand arrangement as set forth in claim 3, wherein said casing upper portion comprises side wall parts extending from said horizontal ceiling and an exhaust opening provided in at least one of said side wall parts, said at least one exhaust conduit running into said exhaust opening.

5. A filling stand arrangement as set forth in claim 2, wherein said casing lower portion comprises side walls arranged transversely to the direction of displacement of said casing upper portion, which side walls are widened in a flange-like manner in the direction of displacement of said casing upper portion.

6. A filling stand arrangement as set forth in claims 3 or 5, further comprising sealing ledges for sealing side wall parts of said casing upper portion, which are arranged in the direction of displacement of said casing upper portion, relative to said casing lower portion.

7. A filling stand arrangement as set forth in claim 6, wherein said sealing ledges are L-shaped and said casing lower portion has side walls with recesses in which said sealing ledges engage.

8. A filling stand arrangement as set forth in claim 2, further comprising casing side wall parts arranged in the direction of displacement of said casing upper portion, each of said casing side wall parts being provided with one exhaust opening and each exhaust opening being allocated to one exhaust conduit.

9. A filling stand arrangement as set forth in claim 1, further comprising centering means provided on the bottom of said casing for securing the position of said metallurgical ladle.

10. A filling stand arrangement as set forth in claim 1, wherein said casing upper portion is displaceable relative to said casing lower portion, an exhaust opening is provided and a flange is provided on said exhaust opening at the outer side of said casing, which flange extends in the direction of displacement of said casing upper portion, and wherein said at least one exhaust conduit includes a transition part widened in the direction of displacement of said casing upper portion, with said transition part being adjacent said flange.

11. A filling stand arrangement as set forth in claim 10, wherein said flange is oval.

12. A filling stand arrangement as set forth in claim 1, wherein said casing upper portion comprises a ceiling, said pour-in opening being provided in said ceiling, and wherein said ceiling is connected with said casing lower portion and is displaceable together with said casing lower portion.

* * * * *